US008626003B2

(12) United States Patent
Dobinson et al.

(10) Patent No.: US 8,626,003 B2
(45) Date of Patent: Jan. 7, 2014

(54) PRINTING DEVICE HAVING INTERNAL GRAPHIC USER INTERFACE DISPLAY

(75) Inventors: Gareth Andrew Dobinson, Hertfordshire (GB); Nicholas Baxter, Hertfordshire (GB); Alexandria Jayne Dobinson, Hertfordshire (GB); Lewis Williams, Barry (GB)

(73) Assignee: Xerox Corporation, Norwalk, CT (US)

( * ) Notice: Subject to any disclaimer, the term of this patent is extended or adjusted under 35 U.S.C. 154(b) by 357 days.

(21) Appl. No.: 13/094,017

(22) Filed: Apr. 26, 2011

(65) Prior Publication Data

US 2012/0274954 A1 Nov. 1, 2012

(51) Int. Cl.
*G03G 15/00* (2006.01)

(52) U.S. Cl.
USPC ..... 399/9; 399/21; 399/81; 399/124

(58) Field of Classification Search
USPC ..... 399/9, 11, 21, 81, 110, 124
See application file for complete search history.

(56) References Cited

U.S. PATENT DOCUMENTS

| | | | | |
|---|---|---|---|---|
| 4,908,655 | A | 3/1990 | Takagi | |
| 5,535,415 | A | 7/1996 | Kondou et al. | |
| 6,032,004 | A | 2/2000 | Mirabella, Jr. et al. | |
| 6,091,915 | A | 7/2000 | Takagishi | |
| 6,658,218 | B2 * | 12/2003 | Krolczyk et al. | 399/21 |
| 7,092,646 | B2 * | 8/2006 | Schroath et al. | 399/81 |
| 7,314,271 | B2 | 1/2008 | Fukano et al. | |
| 7,384,206 | B2 | 6/2008 | Silverbrook et al. | |
| 7,672,600 | B2 * | 3/2010 | Kurokawa et al. | 399/81 |
| 7,887,180 | B2 | 2/2011 | Silverbrook | |
| 2004/0227777 | A1 | 11/2004 | Hananoi | |
| 2009/0256869 | A1 | 10/2009 | Lapstun et al. | |

FOREIGN PATENT DOCUMENTS

| | | |
|---|---|---|
| GB | 1336149 | 11/1973 |
| JP | 2005084061 | 3/2005 |
| WO | 2008018632 | 2/2008 |

* cited by examiner

*Primary Examiner* — William J Royer
(74) *Attorney, Agent, or Firm* — Gibb & Riley, LLC

(57) ABSTRACT

A printing apparatus includes non-transparent doors and/or drawers on a body of the printing apparatus. The non-transparent doors and drawers allow access to internal areas of the body of the printing apparatus. A processor is within the body of the printing apparatus, and the processor controls actions of the printing apparatus. Also, at least one internal graphic user interface display is within the body of the printing apparatus. The internal graphic user interface display is operatively connected to the processor, and the internal graphic user interface display is positioned to be observable only when the non-transparent doors and drawers are open.

20 Claims, 6 Drawing Sheets

PRINTING DEVICE HAVING INTERNAL GRAPHIC USER INTERFACE DISPLAY

BACKGROUND

Embodiments herein generally relate to electrostatic printers, copiers, and reproduction machines, and more particularly, concerns display devices positioned within a body of a printing apparatus that provide instructions for clearing paper jams, and the like.

Modern printing devices are sophisticated machines that are able to process a wide variety of print media at very high speeds and produce almost lifelike quality images. However, occasionally a user or service engineer needs to access interior regions of such printing machines in order to perform service or clear paper jams. Often, it is difficult to see service/paper jam clearing instructions provided on a standard external graphic user interface. The embodiments described below assists in such efforts and make it easier for the user/service engineer to see instructions while the user/service engineer is working within the internal confines of the printing machine.

SUMMARY

Embodiments herein include a printing apparatus that comprises a body and non-transparent doors and/or drawers on the body. The non-transparent doors and drawers allow access to internal areas of the body of the printing apparatus. Further, a media path that is within the body of the printing apparatus moves sheets of media through the body. Also, a marking engine is within the body of the printing apparatus, and the media path supplies the sheets of media to the marking engine. A processor within the body of the printing apparatus is operatively connected to the marking engine and controls actions of the marking engine. Herein an item is "operatively" connected to another item when it is directly or indirectly connected (electrically, mechanically, functionally, and the like) to the other item.

Additionally, the printing apparatus includes at least one external graphic user interface display positioned on the body of the printing apparatus and at least one internal graphic user interface display within the body of the printing apparatus. The external and internal graphic user interface displays can be, for example, plastic electronic displays, liquid crystal displays (LCDs), light emitting diode (LED) displays, touch screen displays, plasma displays, cathode ray tube displays, and the like (or any combination of such displays).

The internal graphic user interface display is positioned to be observable only when the non-transparent doors and drawers are open. To the contrary, the external graphic user interface display is visible when the doors and drawers are open or closed. The external and internal graphic user interface displays are both operatively connected to the processor. Further, the external graphic user interface display and the internal graphic user interface display can simultaneously provide instructions for clearing a jam within the media path.

Some embodiments can include door and drawer sensors on the doors and drawers (the door and drawer sensors are also operatively connected to the processor). In these embodiments, the processor activates the internal graphic user interface display only when the door and drawer sensors detect that at least one of the doors or drawers is open. Other embodiments can include at least one paper jam clearing mechanism connected to the media path. The internal graphic user interface display is positioned adjacent to such paper jam clearing mechanism(s).

Further, the paper jam clearing mechanisms can comprise a plastic electronic material and can be operatively connected to the processor. This allows the paper jam clearing mechanisms to optionally light up in coordination with the paper jam clearing instructions that are provided on the internal graphic user interface display.

An exemplary method embodiment herein automatically detects a paper jam within a printing apparatus. At least one non-transparent door and/or drawer on a body of the printing apparatus is opened to provide access to internal areas of the body of the printing apparatus. The method can provide user instructions through an external graphic user interface display positioned on the body of the printing apparatus (the external graphic user interface display is visible when the doors and drawers are open or closed). Further, the method automatically provides instructions to clear the paper jam using at least one internal graphic user interface display within the body of the printing apparatus. The internal graphic user interface display is positioned to be observable only when the non-transparent doors and drawers are open. The internal and external graphic user interface display can comprise a plastic electronic display, a liquid crystal display (LCD), a light emitting diode (LED) display, a touch screen display, a plasma display, a cathode ray tube display, and the like.

In some embodiments, the method can activate the internal graphic user interface display only when door and drawer sensors detect at least one of the doors or drawers being open. Additionally, the internal graphic user interface display can be positioned adjacent to at least one paper jam clearing mechanism within the body of the printing apparatus.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, it can be difficult to see the service/paper jam clearing instructions provided on the standard external graphic user interface (GUI), because standard external graphic user interfaces are on a different plane to (at a different height from) the marking engine and hence users cannot see the graphic user interface when trying to clear a paper jam. More specifically, once a user opens a print engine door, most print engines are lower than the standard external graphic user interface and it is inconvenient to continually bend up and down to see the jam clearance procedure and then carry out the procedure to clear the jam. This can result in a user having to bend up and down multiple times in order to ensure that they have cleared the jam correctly and to follow the jam clearance instructions.

The embodiments herein address this issue by providing at least one graphic user interface within the internal body of the machine. Thus, with embodiments herein, the jam clearance instructions can be displayed on a main external graphic user interface, as well as on the internal graphic user interface. With this, a user does not continually have to move between the print engine and the external graphic user interface in order to follow the instructions.

Further, in order to reduce the cost of providing multiple graphic user interface displays on each device, and to reduce the amount of room they occupy, the internal graphic user interface displays can be plastic electronic displays that are available from Plastic Logic (Mountain View, Calif., USA) and Rusnano (Zelenograd, Russia). Such plastic electronic displays can be manufactured purely through plastic printing, making them smaller, lighter, and less expensive than conventional displays. Alternatively, the displays mentioned herein can comprise small and inexpensive liquid crystal displays (LCDs), light emitting diode (LED) displays, touch screen displays, plasma displays, cathode ray tube displays, and the like, (or any combination of such displays).

Figure 1:
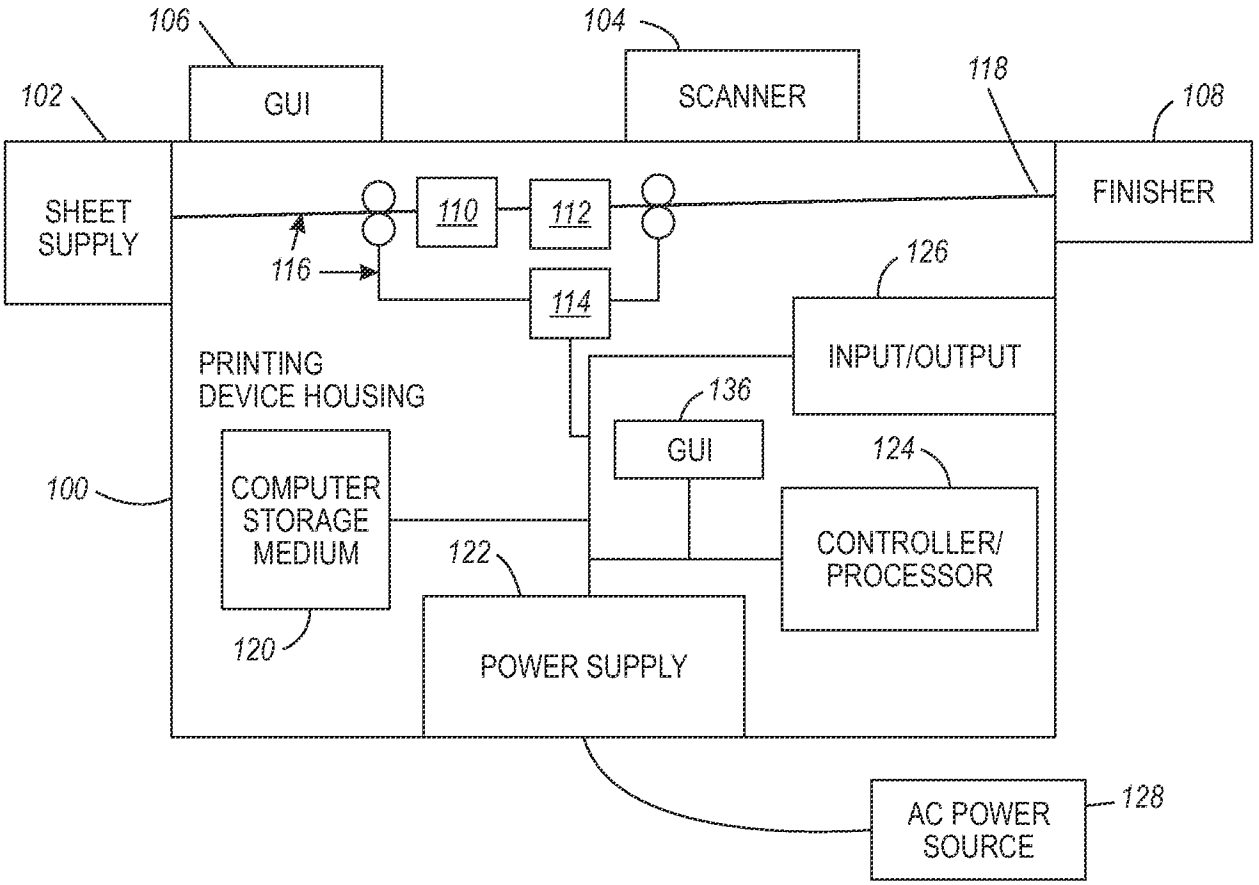
FIG. 1 is a side-view schematic diagram of a device according to embodiments herein.

FIG. 1 illustrates a computerized printing device printing apparatus 100, which can be used with embodiments herein and can comprise, for example, a printer, copier, multi-function machine, and the like. The printing device 100 includes a controller/processor 124, at least one marking device (printing engines) 110, 112, 114 operatively connected to the controller/processor 124, media path 116 positioned to supply sheets of media from a sheet supply 102 to the marking device(s) 110, 112, 114, and a communications port (input/output) 126 operatively connected to the processor 124 and to a computerized network external to the printing device 100. After receiving various markings from the marking devices(s) 110, 112, 114, the sheets of media can optionally pass to a finisher 108 which can fold, staple, sort, and the like, the various printed sheets.

Thus, the sheet supply 102 stores sheets of media and there is the media path 116 within a body 100 of the printing device 100 (which has a beginning, a middle, and an end) and the beginning of the media path 116 is adjacent the sheet supply 102. The media path 116 moves the sheets of media through the body of the printing device 100 from the beginning to the end.

The middle of the media path 116 is adjacent the marking devices 110, 112, 114. The media path 116 supplies the printing media to the marking devices 110, 112, 114, and the marking devices 110, 112, 114 prints marks on the printing media in a printing process to create printed sheets. A media exit 118 is operatively connected to the body of the printing and to the finisher 108. The end of the media path 116 is adjacent the media exit 118, and the media path 116 moves the printed sheets from the marking engine 110, 112, 114 to the media exit 118.

Also, the printing device 100 includes at least one accessory functional component (such as a scanner/document handler (scanner) 104, sheet supply 102, finisher 108, and the like), an external graphic user interface (GUI) 106, and an internal graphic user interface assembly 136 that also operate on the power supplied from an external power source (AC power source) 128 (through a power supply 122).

The input/output 126 is used for communications to and from the printing device 100. The controller/processor 124 controls the various actions of the printing device 100. A non-transitory computer storage medium device(computer storage medium) 120 (which can be optical, magnetic, capacitor based, and the like) is readable by the controller/processor 124 and stores instructions that the controller/processor 124 executes to allow the printing device 100 to perform its various functions, such as those described herein.

Thus, a printer body housing has one or more functional components that operate on power supplied from the external power source 128 by the power supply 122. The power supply 122 connects to the external power source 128 and converts the external power into the type of power needed by the various components.

As would be understood by those ordinarily skilled in the art, the printing device 100 shown in FIG. 1 is only one example and the embodiments herein are equally applicable to other types of printing devices that may include fewer components or more components. For example, while a limited number of printing engines and paper paths are illustrated in FIG. 1, those ordinarily skilled in the art would understand that many more paper paths and additional printing engines could be included within any printing device used with embodiments herein.

FIGS. 2-6 present different schematic diagrams of a portion of the same printing body housing. More specifically, starting with FIG. 2, the printer body can include door and/or drawers 240 positioned on the body that allow access to the internal areas of the body of the printing device 100. Note that the various internal elements such as: roll elements 220, 222, 224 (which can be, for example, transfer rolls, fuser rolls, support rolls, and the like); handles 202, 204, 206; media support elements 210, 212, 214 (which can be belts, guides, roller nips, and the like); and other processing elements 226 (which can comprise any element commonly found within a printing device, whether currently known or developed in the future) are only a portion of the actual elements that may be included within a given printing device 100.

Further, the shape, location, and size, of such elements is not necessarily drawn to scale and would vary from machine to machine. Therefore, it would be understood by those ordinarily skilled in the art that FIGS. 2-6 only illustrate a partial internal view of a simplified example of the internal arrangement within an exemplary printing device 100 and that the embodiments herein are equally applicable to many other types of printing devices that may contain many more (or less) components and elements.

Figure 2:
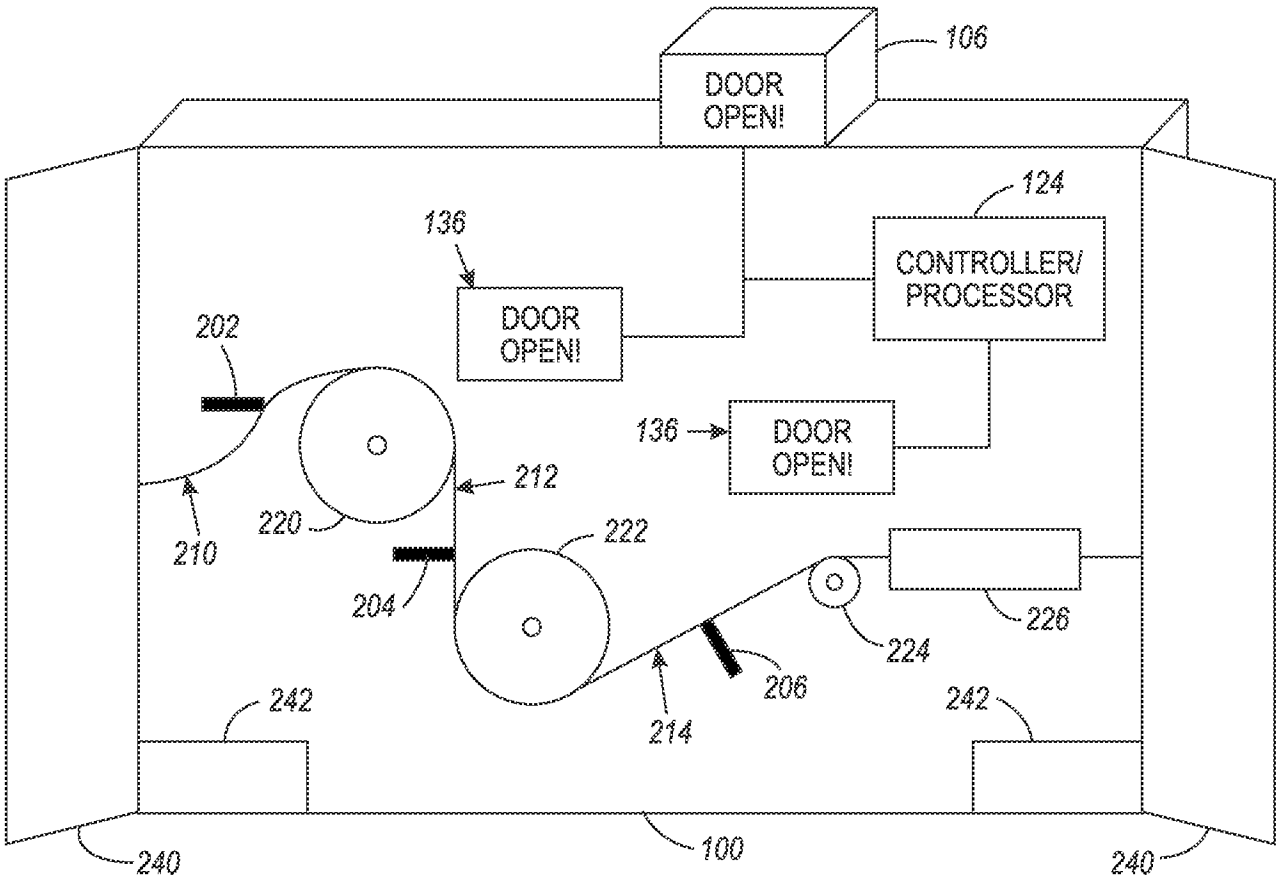
FIG. 2 is a perspective side-view schematic diagram of a device according to embodiments herein that has the doors or drawers open.

As shown in FIG. 2, door and drawer sensors 242 are positioned adjacent the door and drawers 240. The door and drawer sensors 242 are operatively connected to the controller/processor 124 and inform the controller/processor 124 when the door and drawers 240 are open.

Additionally, at least one internal graphic user interface 136 is within the body of the printing device 100 (and operatively connected to the controller/processor 124). The internal and external graphic user interfaces 106, 136 can provide sequential instructions to guide a user through a multi-step process of checking different areas of the media path 116 to remove a paper jam.

The external and internal graphic user interface displays 106, 136 can be any form of display that is capable of displaying words, directions, instructions, graphic symbols, and the like, (whether now known or developed in the future). Thus, the displays are more than mere lights, but instead comprise an array of pixels (e.g., 32×32; 640×640; 1080×1080, and the like) capable of forming shapes. For example, the external and internal graphic user interface displays 106, 136 can be plastic electronic displays, liquid crystal displays (LCDs), light emitting diode (LED) displays, touch screen displays, plasma displays, cathode ray tube displays, and the like, (or any combination of such displays). The term "internal" herein means inside or within the body of the printing device 100, and "external" means connected to (or disconnected from) the outside of the printing device 100.

Figure 6:
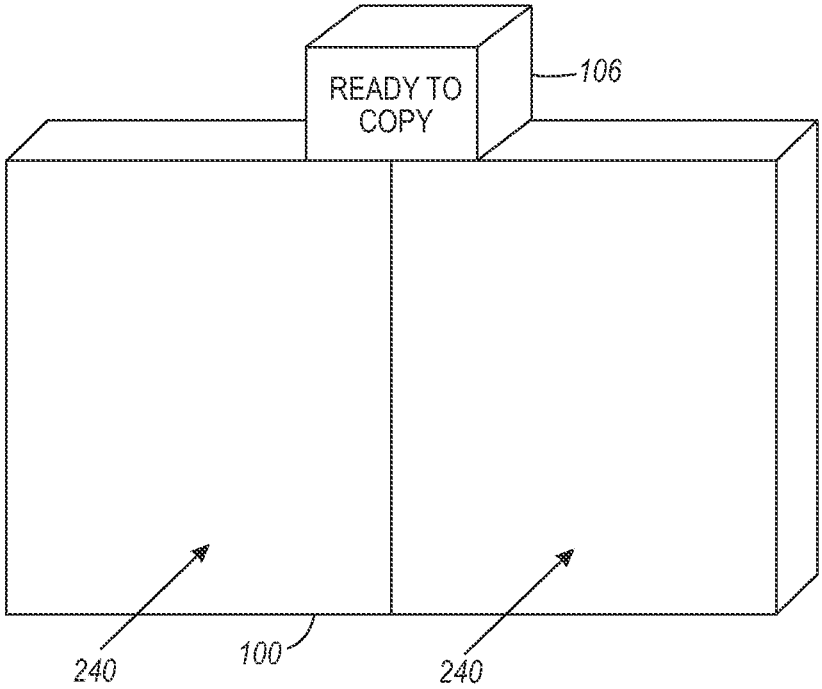
FIG. 6 is a perspective side-view schematic diagram of a device according to embodiments herein that has the doors or drawers closed.

The internal graphic user interface display 136 is positioned to be observable only when the non-transparent doors and drawers 240 are open. To the contrary, the external graphic user interface display 106 is visible when the doors and drawers 240 are open or closed. For example, as shown in FIG. 6, the external graphic user interface display 106 is the only display visible when the doors/drawers 240 are closed.

The external and internal graphic user interface displays 106, 136 are both operatively connected to the controller/processor 124, and the controller/processor 124 can activate the internal graphic user interface display 136 only when the door and drawer sensors 242 detect that at least one of the doors and drawers 240 is open. For example, both internal graphic user interface displays 136 are activated and inform the user that the door 240 is open using the message "Door Open!"

Some embodiments can include at least one paper jam clearing mechanism (represented by handles 202, 204, 206) connected to movable parts of the media path 116. The internal graphic user interface display 136 can be conveniently positioned adjacent to such paper jam clearing mechanism(s) 202, 204, 206.

Figure 3:
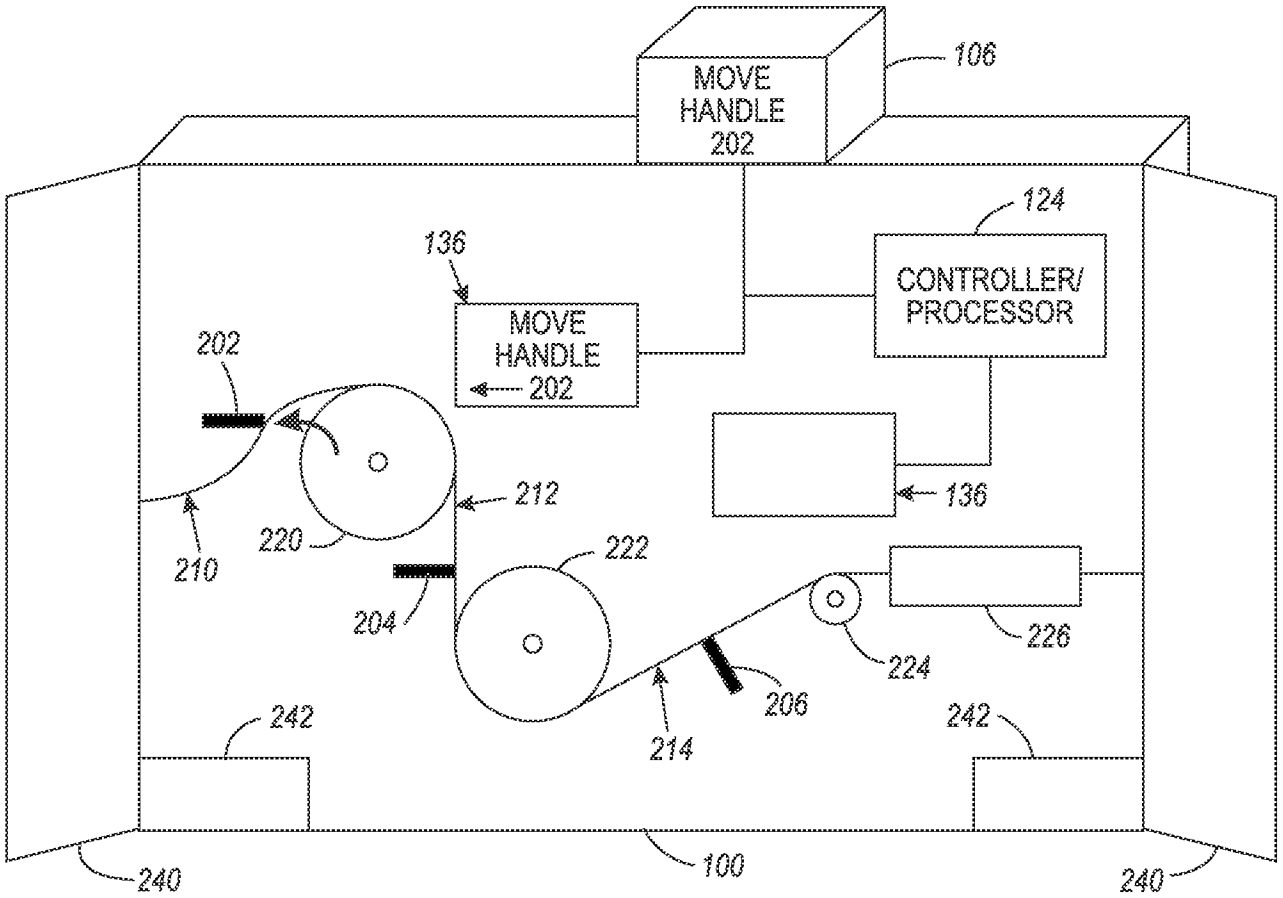
FIG. 3 is a perspective side-view schematic diagram of a device according to embodiments herein that has the doors or drawers open.
Figure 4:
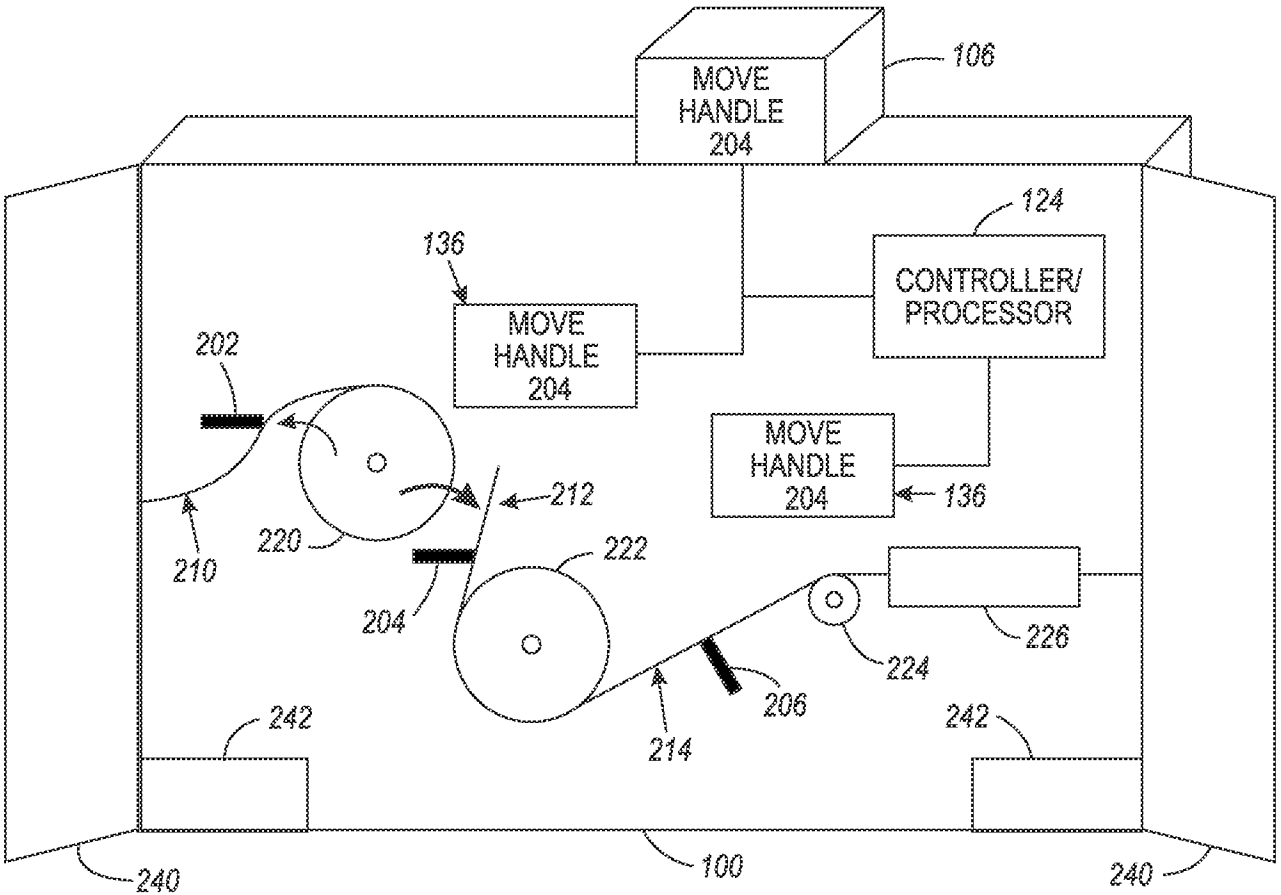
FIG. 4 is a perspective side-view schematic diagram of a device according to embodiments herein that has the doors or drawers open.
Figure 5:
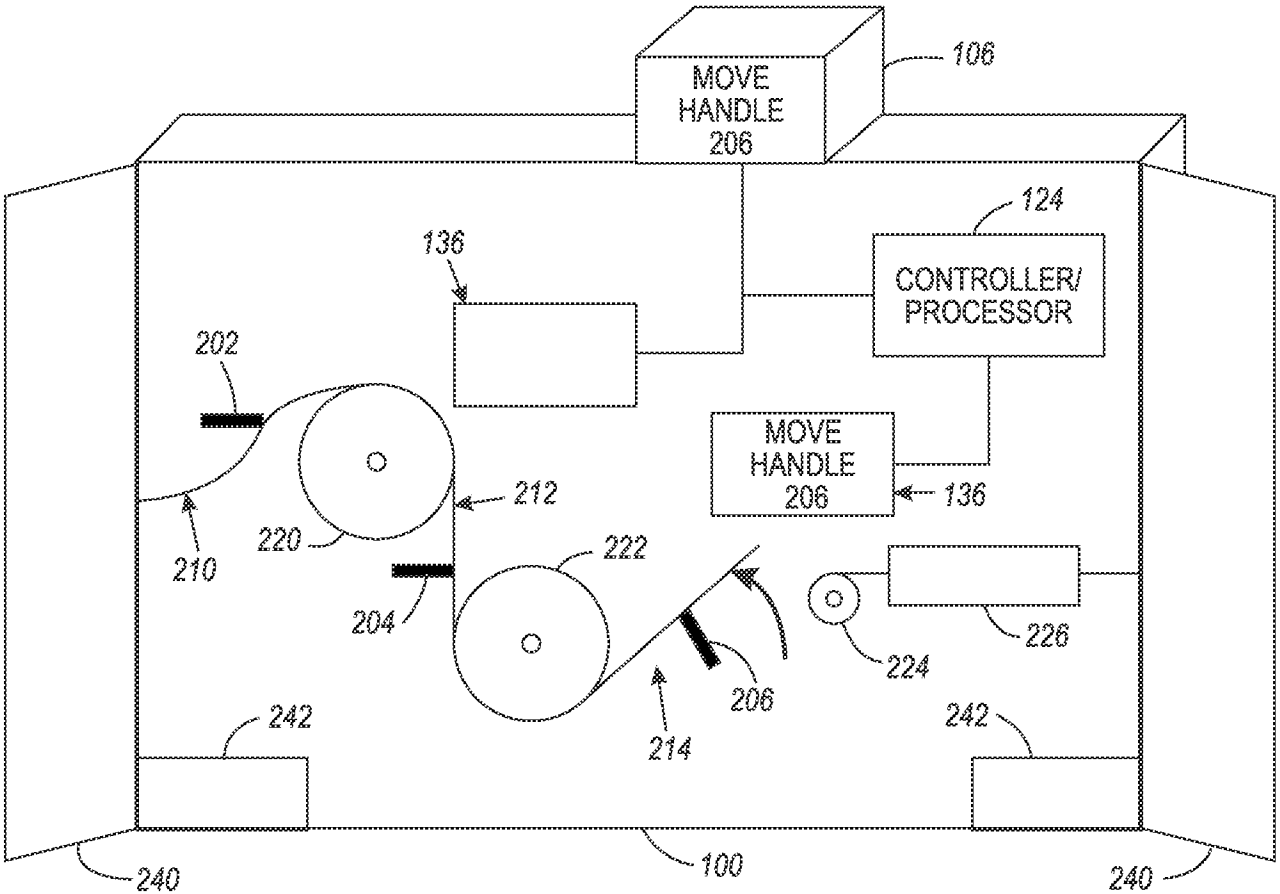
FIG. 5 is a perspective side-view schematic diagram of a device according to embodiments herein that has the doors or drawers open.

Further, the external graphic user interface display 106 and the internal graphic user interface display 136 can simultaneously provide the same instructions for clearing a jam within the media path 116, as illustrated in FIGS. 3-5. More specifically, as shown in FIG. 3, the external and internal graphic user interfaces 106, 136 can simultaneously display an instruction to the user to move handle number 202 using the message "Move Handle 202."Moving handle 202 causes media support element 210 of the media path 116 to be lifted off roll element 220 and help locate the potential paper jam.

Further, the paper jam clearing mechanisms 202, 204, 206 can comprise a plastic electronic material and can be operatively connected to the controller/processor 124. This allows the paper jam clearing mechanisms 202, 204, 206 to optionally light up in coordination with the paper jam clearing instructions that are provided on the internal graphic user interface display 136.

In some embodiments, if there are multiple internal graphic user interface displays 136, as shown in FIG. 3, the only display that can be activated is the one closest (relative to all other displays) to the paper jam clearing mechanism 202 that needs to be operated by the user. In addition, this message can blink or change appearance (change color, brightness, font size, and the like) while being presented on only one of the internal graphic user interface displays 106 in order to draw the user's attention to the area closest to handle 202 and allow the user to more easily locate and move handle 202. Further, handle 202 can simultaneously light up, blink, and the like.

Similarly, as shown in FIGS. 4 and 5, the message on the internal and external graphic user interfaces 106, 136 changes to instruct the user to sequentially move handles 204 and 206 and such handles can light up, blink, and the like, in coordination with the jam clearing instructions. In FIG. 4, both internal graphic user interface displays 136 display the message "Move Handle 204"; while, in FIG. 5, only the internal graphic user interface display 136 closest to handle 206 displays the message "Move Handle 206." Also, the external graphic user interface diplay 106 may or may not simultaneously display the same message being displayed on the internal graphic user interface displays 136, and the internal graphic user interface display 136 can show an arrow pointing to the handle 202, 204, 206 that needs to be moved.

Figure 7:
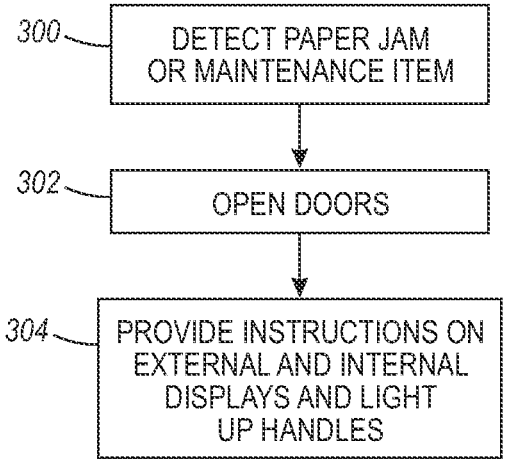
FIG. 7 is a flowchart illustrating various method embodiments herein.

Method embodiments herein are illustrated in the drawings using a common flowchart, shown in FIG. 7. More specifically, in item 300, an exemplary method embodiment herein automatically detects a paper jam or a maintenance condition that needs servicing within the printing device. At least one non-transparent door and/or drawer on a body of the printing device is opened in item 302 to provide access to internal areas of the body. In some embodiments, the method can activate the internal graphic user interface display only when door and drawer sensors detect at least one of the doors and drawers being open.

Then, in item 304, the method can provide user instructions to clear the jam or perform the service simultaneously through the external graphic user interface display positioned on the body of the printing device (the external graphic user interface display is visible when the doors and drawers are open or closed) and through at least one internal graphic user interface display within the body of the printing device. Additionally, at the same time, one or more of the handles can light up.

As mentioned above, the internal graphic user interface display is positioned to be observable only when the non-transparent doors and drawers are open to avoid requiring the user to look to the external graphic user interface display when clearing paper jams or performing service within the body of the printing device. Additionally, as also stated above, the internal graphic user interface display can be positioned adjacent to at least one paper jam clearing mechanism within the body of the printing to help draw the user's attention to the paper jam clearing mechanism that needs to be operated.

Many computerized devices are discussed above. Computerized devices that include chip-based central processing units (CPU's), input/output devices (including graphic user interfaces (GUI)), memories, comparators, processors, and the like, are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, and the like, the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, and the like, which performs a print outputting function for any purpose. The details of printers, printing engines, and the like, are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", and the like, used herein are understood to be relative locations as they are oriented and illustrated in the drawings (unless otherwise indicated). Terms such as "touching", "on", "in direct contact", "abutting", "directly adjacent to", and the like, mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A printing apparatus comprising:

a body;

at least one of non-transparent doors and drawers on said body of said printing apparatus, said non-transparent doors and drawers allowing access to internal areas of said body of said printing apparatus;

a processor within said body of said printing apparatus, said processor controlling actions of said printing apparatus;

internal graphic user interface displays within said body of said printing apparatus, said internal graphic user interface displays being operatively connected to said processor, said internal graphic user interface displays being positioned to be observable only when said non-transparent doors and drawers are open; and paper jam clearing mechanisms within said internal areas of said body of said printing apparatus, said internal graphic user interface displays being positioned adjacent different ones of said paper jam clearing mechanisms, and said processor controlling said internal graphic user interface displays to only activate a single internal graphic user interface display of said internal graphic user interface displays that is closest, relative to all other internal graphic user interface displays, to one of said paper jam clearing mechanisms that said single internal graphic user interface display is instructing a user to operate.

2. The printing apparatus according to claim 1, further comprising:

door and drawer sensors on said doors and drawers, said door and drawer sensors being operatively connected to said processor, said processor activating said internal graphic user interface displays only when said door and drawer sensors detect at least one of said doors and drawers being open.

3. The printing apparatus according to claim 1, said paper jam clearing mechanisms comprising a plastic electronic material operatively connected to said processor, said paper jam clearing mechanisms lighting up in coordination with paper jam clearing instructions provided on said internal graphic user interface displays.

4. The printing apparatus according to claim 1, each of said internal graphic user interface displays comprising one of, a liquid crystal display (LCD), a light emitting diode (LED) display, a touch screen display, a plasma display, and a cathode ray tube display.

5. The printing apparatus according to claim 1, said single internal graphic user interface display displaying an arrow pointing to said one of said paper jam clearing mechanisms when activated.

6. A printing apparatus comprising:

a body;

at least one of non-transparent doors and drawers on said body of said printing apparatus, said non-transparent doors and drawers allowing access to internal areas of said body of said printing apparatus;

a media path within said body of said printing apparatus, said media path moving sheets of media through said body of said printing apparatus;

a marking engine within said body of said printing apparatus, said media path supplying said sheets of media to said marking engine;

a processor within said body of said printing apparatus, said processor being operatively connected to said marking engine, said processor controlling actions of said marking engine;

internal graphic user interface displays within said body of said printing apparatus, said internal graphic user interface displays being operatively connected to said processor, said internal graphic user interface displays being positioned to be observable only when said non-transparent doors and drawers are open: and paper jam clearing mechanisms within said internal areas of said body of said printing apparatus, said internal graphic user interface displays being positioned adjacent different ones of said paper jam clearing mechanisms, and said processor controlling said internal graphic user interface displays to only activate a single internal graphic user interface display of said internal graphic user interface displays that is closest, relative to all other internal graphic user interface display to one of said paper jam clearing mechanisms that said single internal graphic user interface display is instructing a user to operate.

7. The printing apparatus according to claim 6, further comprising:

door and drawer sensors on said doors and drawers, said door and drawer sensors being operatively connected to said processor, said processor activating said internal graphic user interface displays only when said door and drawer sensors detect at least one of said doors and drawers being open.

8. The printing apparatus according to claim 6, said paper jam clearing mechanisms comprising a plastic electronic material operatively connected to said processor, said paper jam clearing mechanisms lighting up in coordination with paper jam clearing instructions provided on said internal graphic user interface displays.

9. The printing apparatus according to claim 6, each of said internal graphic user interface displays comprising one of a plastic electronic display, a liquid crystal display (LCD), a light emitting diode (LED) display, a touch screen display, a plasma display, and a cathode ray tube display.

10. The printing apparatus according to claim 6, said single internal graphic user Interface display displaying an arrow pointing to said one of said paper jam clearing mechanisms when activated.

11. A printing apparatus comprising:

a body;

at least one of non-transparent doors and drawers on said body of said printing apparatus, said non-transparent doors and drawers allowing access to internal areas of said body of said printing apparatus;

a media path within said body of said printing apparatus, said media path moving sheets of media through said body of said printing apparatus;

a marking engine within said body of said printing apparatus, said media path supplying said sheets of media to said marking engine;

a processor within said body of said printing apparatus, said processor being operatively connected to said marking engine, said processor controlling actions of said marking engine;

an external graphic user interface display positioned on said body of said printing apparatus, said external graphic user interface display being operatively connected to said processor, and said external graphic user interface display being visible when said doors and drawers are open or closed;

internal graphic user interface displays within said body of said printing apparatus, said internal graphic user interface displays being operatively connected to said processor, said internal graphic user interface displays being positioned to be observable only when said non-transparent doors and drawers are open, and said external graphic user interface display and said internal graphic user interface displays simultaneously providing instructions for clearing a jam within said media path; and paper jam clearing mechanisms within said internal areas of said body of said printing apparatus, said internal graphic user interface displays being positioned adjacent different ones of said paper jam clearing mechanisms, and said processor controlling said internal graphic user interface display to only activate a single internal graphic user interface display of said internal graphic user interface displays that is closest, relative to all other internal graphic user interface display, to one of said paper jam clearing mechanisms that said single internal graphic user interface display is instructing a user to operate.

12. The printing apparatus according to claim 11, further comprising:

door and drawer sensors on said doors and drawers, said door and drawer sensors being operatively connected to said processor, said processor activating said internal graphic user interface displays only when said door and drawer sensors detect at least one of said doors and drawers being open.

13. The printing apparatus according to claim 11, said paper jam clearing mechanisms comprising a plastic electronic material operatively connected to said processor, said paper jam clearing mechanisms lighting up in coordination with paper jam clearing instructions provided on said internal graphic user interface displays.

14. The printing apparatus according to claim 11, each of said internal graphic user interface displays comprising one of a plastic electronic display, a liquid crystal display (LCD), a light emitting diode (LED) display, a touch screen display, a plasma display, and a cathode ray tube display.

15. The printing apparatus according to claim 11, said single internal graphic user interface display displaying an arrow pointing to said one of said paper jam clearing mechanisms when activated.

16. A method comprising:

automatically detecting a paper jam within a printing apparatus;

opening at least one of non-transparent doors and drawers on a body of said printing apparatus to provide access to internal areas of said body of said printing apparatus; and automatically providing instructions to clear said paper jam using internal graphic user interface displays within said body of said printing apparatus, said internal graphic user interface displays being positioned to be observable only when said non-transparent doors and drawers are open, said providing instructions comprising controlling said internal graphic user interface displays to only activate a single internal graphic user interface display of said internal graphic user interface displays that is closest, relative to all other internal graphic user interface displays, to one of paper jam clearing mechanisms that said single internal graphic user interface display is instructing a user to operate, said paper jam clearing mechanisms being positioned within said internal areas of said body of said printing apparatus, and said internal graphic user interface displays being positioned adjacent different ones of said paper jam clearing mechanisms.

17. The method according to claim 16, further comprising activating said internal graphic user interface displays only when door and drawer sensors detect at least one of said doors and drawers being open.

18. The method according to claim 16, further comprising lighting up said paper jam clearing mechanisms in coordination with paper jam clearing instructions provided on said internal graphic user interface displays, said paper jam clearing mechanisms comprising a plastic electronic material.

19. The method according to claim 16, each of said internal graphic user interface displays comprising one of a plastic electronic display, a liquid crystal display (LCD), a light emitting diode (LED) display, a touch screen display, a plasma display, and a cathode ray tube display.

20. The method according to claim 16, said single internal graphic user interface display displaying an arrow pointing to said one of said paper jam clearing mechanisms when activated.

* * * * *